US008079857B2

(12) United States Patent
Zhu

(10) Patent No.: US 8,079,857 B2
(45) Date of Patent: Dec. 20, 2011

(54) ELECTRICAL CONNECTOR WITH DRAINAGE CHANNELS

(75) Inventor: Yu Zhu, shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 30 days.

(21) Appl. No.: 12/787,409

(22) Filed: May 26, 2010

(65) Prior Publication Data

US 2011/0065299 A1 Mar. 17, 2011

(30) Foreign Application Priority Data

Sep. 17, 2009 (CN) ..... 2009 2 0310586

(51) Int. Cl.
*H01R 4/60* (2006.01)

(52) U.S. Cl. ..... 439/205

(58) Field of Classification Search ..... 439/190, 439/205

See application file for complete search history.

(56) References Cited

U.S. PATENT DOCUMENTS

2011/0065299 A1* 3/2011 Zhu ..... 439/190

* cited by examiner

*Primary Examiner* — James Harvey

(74) *Attorney, Agent, or Firm* — Wei Te Chung; Andrew C. Cheng; Ming Chieh Chang

(57) ABSTRACT

An electrical connector 100 has a dielectric housing 1 defining a plurality of passageways 14 and a plurality of contacts 2 disposed in the passageways 14. Each passageway 14 has a mounting slot 142 for retaining the contact 2. Water drainage channels include at least one slot 145 below the retaining section 142 and an opening 15 communicating with the slot 145 and the passageways 14 so as to facilitating the drainage of water from an electrical connector 100.

13 Claims, 4 Drawing Sheets

ELECTRICAL CONNECTOR WITH DRAINAGE CHANNELS

BACKGROUND OF THE INVENTION

1. Field of the Invention

The present invention generally relates to an electrical connector, and more particularly, to a novel structure of a housing for facilitating the drainage of water from an electrical connector.

2. Description of Related Art

Electrical connectors applied to hard disc drive need high sensitivity and cleanliness. Electrical connectors need to be cleaned for better working.

The most board to board electrical connectors in industry are small in size. The electrical connector includes a dielectric housing having a plurality of terminal passageways and a plurality of terminals disposed in the passageways. When the terminal is assembled in the passageway, there isn't enough space to drainage in the passageway. The water remained in the passageways causes misconnection of the electrical connector.

Hence, the present invention is directed to solving this problem in the related art.

SUMMARY OF THE INVENTION

An object of the invention is to provide an electrical connector which has drainage channels.

In order to achieve the object set forth, an electrical connector has a dielectric housing defining a plurality of passageways and a plurality of contacts disposed in the passageways. Each passageway has a retaining section for retaining the contact. Water drainage channel includes at least one slot below the retaining section and an opening communicating with the slot and the passageways so as to facilitating the drainage of water from an electrical connector.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
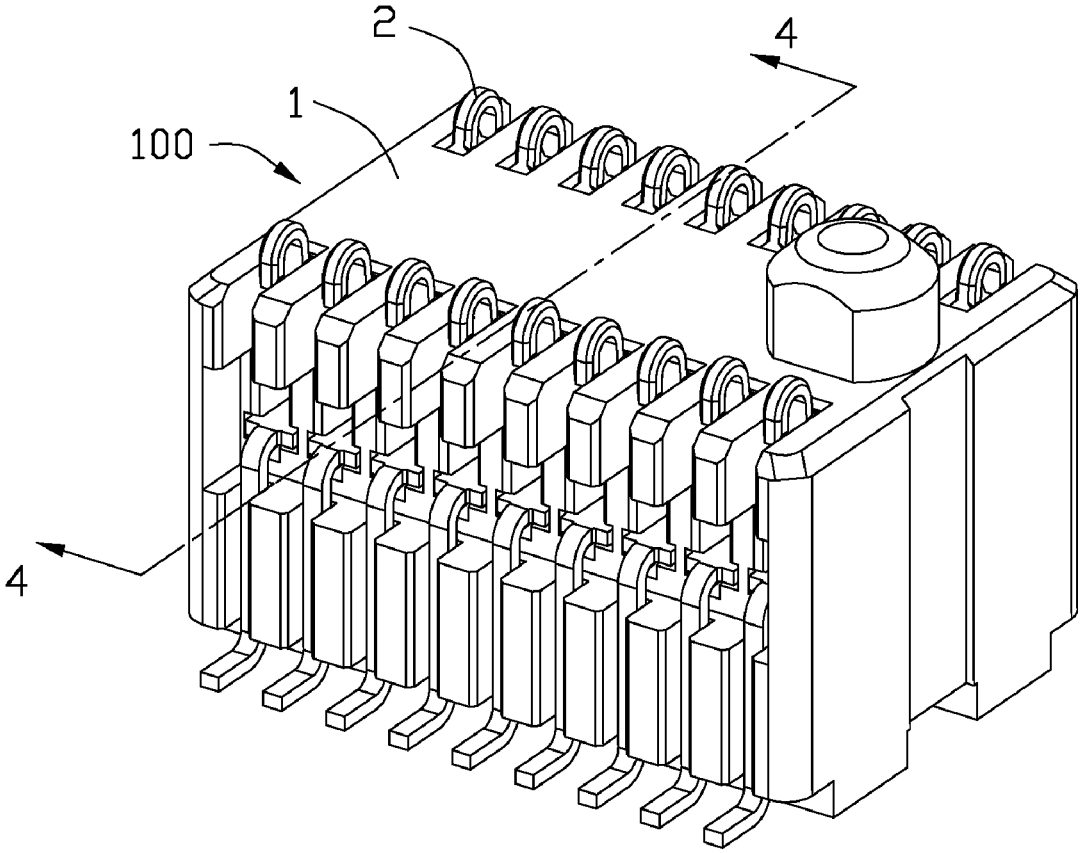
FIG. 1 is a top perspective view of an electrical connector of an embodiment of the present invention.
Figure 3:
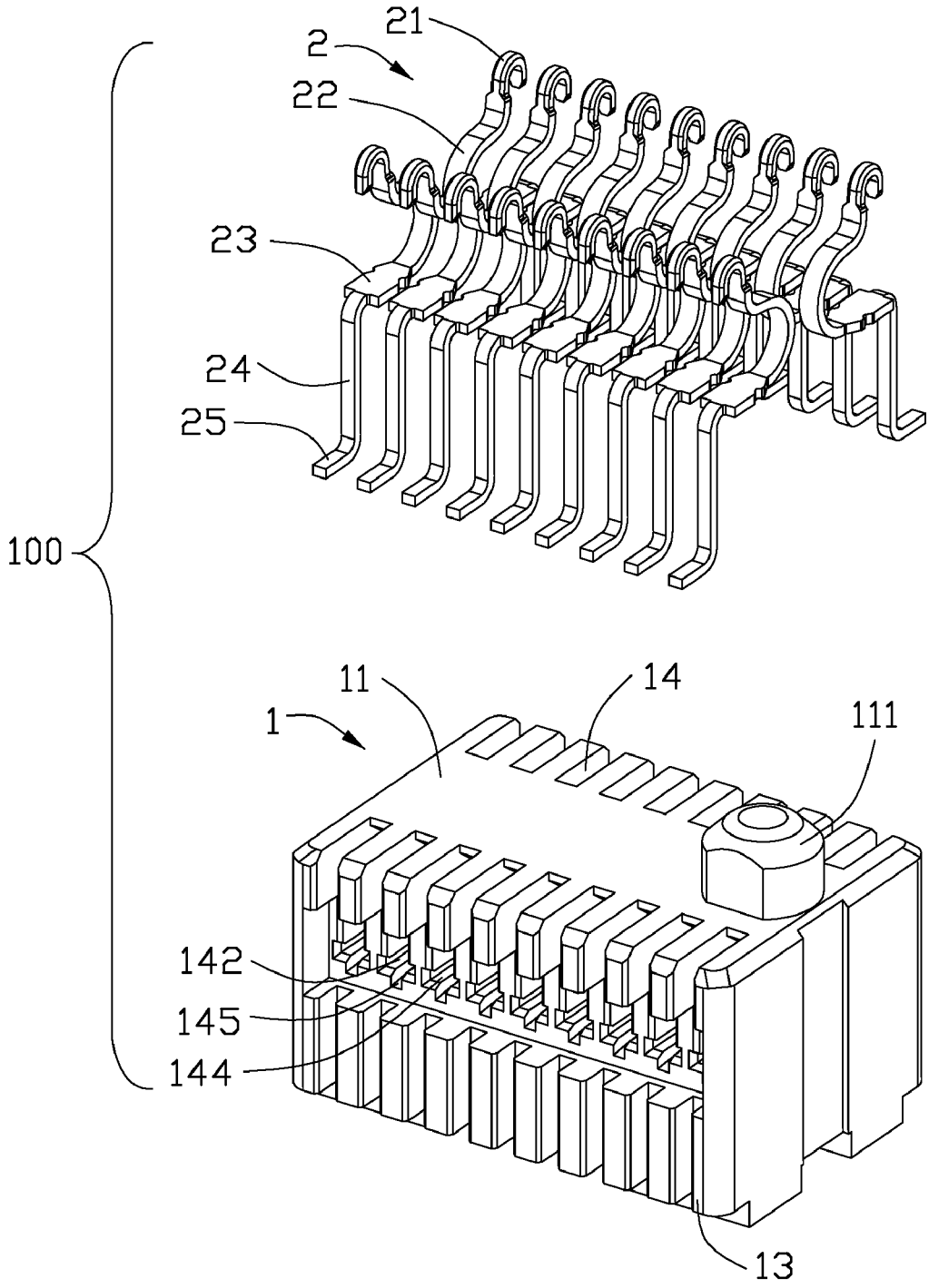
FIG. 3 is an exploded perspective view of the electrical connector as shown in FIG. 1.

Referring to FIGS. 1 and 3, an electrical connector 100 for connecting one printed circuit board to another printed circuit board (not shown) in accordance with an embodiment of the present invention comprises a dielectric housing 1 with a number of terminal passageways 14 extending to an exterior in both vertical and horizontal directions, and a plurality of terminals 2 deflectably moving within the terminal passages 14.

Figure 2:
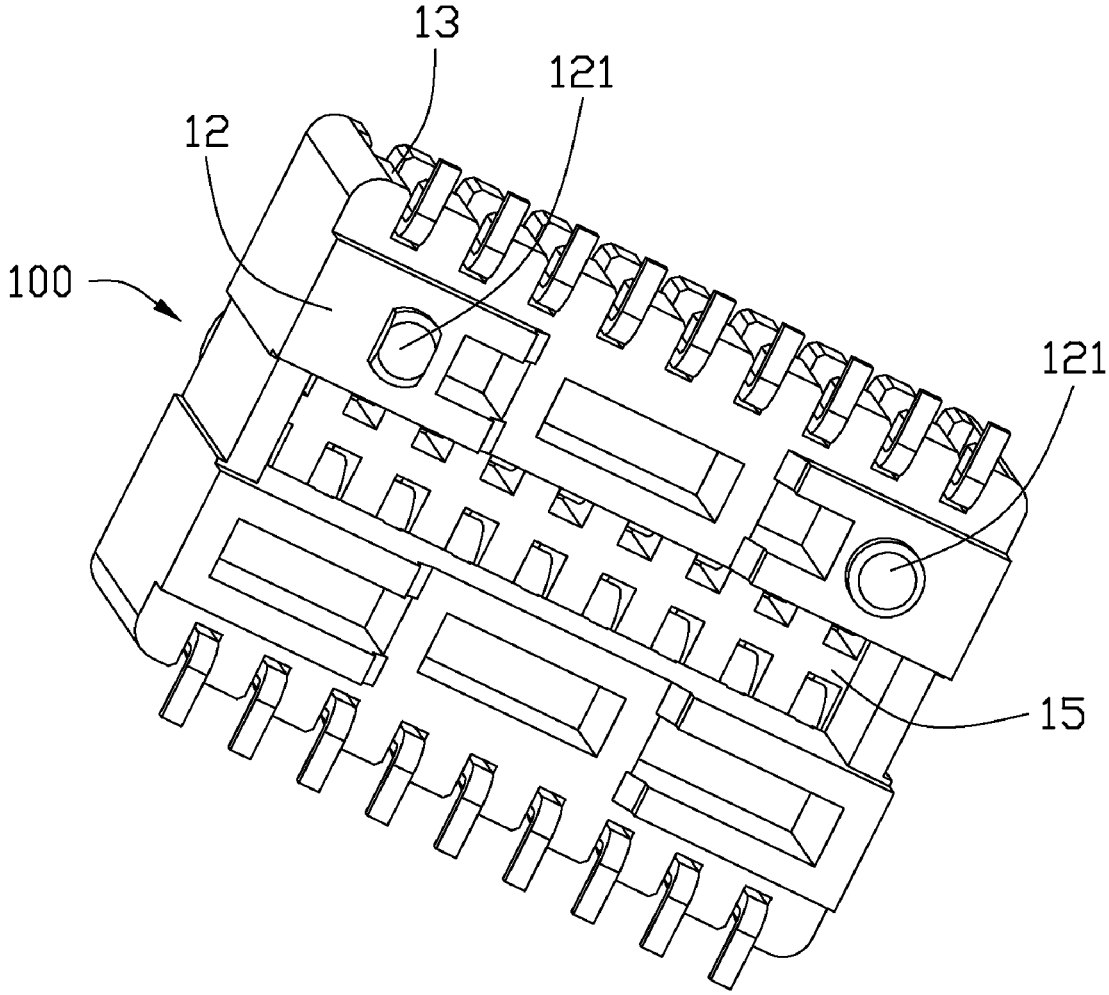
FIG. 2 is a bottom perspective view of the electrical connector.
Figure 4:
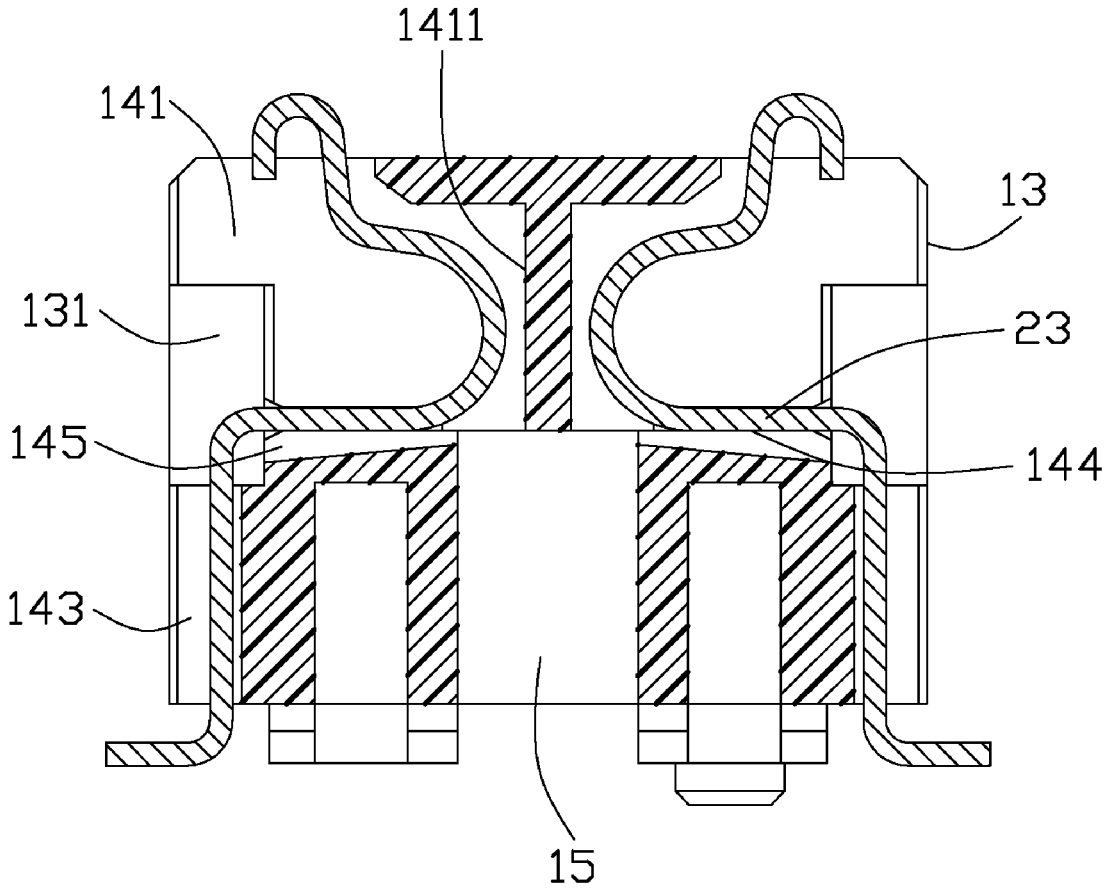
FIG. 4 is a cross-sectional view of the electrical connector taken along lines 4-4 in FIG. 1.

Referring to FIGS. 2-4, the dielectric housing 1 comprises a mating face 11, a board-mounting face 12 opposite to the mating face 11 and two side face 13 connecting with the mating face 11 and a board-mounting face 12. The terminal passageways 14 are arranged at two opposite sides in lengthwise direction and extend through the mating face 11 and the board-mounting face 12 and the side faces 13. Each terminal passageway 14 has a first section 141 adjacent to the mating face 11, a second section 142 communicating with the first section 141 and a third section 143 adjacent to the board-mounting face 12. Each side face 13 of the housing 1 has a recess 131 extending from the side face 13 to the middle of the housing 1. The recess 131 communicates with the first section 141, the second section 142 and the third section 143. The second section 142 extends in horizontal direction and has a bottom face 144 which the terminal 2 joints on (refer to FIG. 4). The housing 1 has a stand-off below the first section 141 and extending from the bottom face 144 to the board-mounting face 12. The third section 143 is at the side of the stand-off. Water drainage channels comprise at least one slot 145 below the second section 142 and an opening 15 communicating with the board-mounting face 12. The slot 145 depresses from the bottom face 144 to the board-mounting face 12 so as to facilitate the drainage of water from the second section 142. The opening 15 extends through the bottom face 144 and the board-mounting face and communicates with the slot 145 and passageways 14. The two rows of passageways are symmetric about the opening 15, and the opening 15 is under the first section 141. Most of water is drainaged from the opening 15. The slot 145 is defined an inclined slot. The end of the slot 145 adjacent to the side face 13 is higher than the other end adjacent to the opening 15. Each first section 141 has an inner face 1411 (refer to FIG. 4).

Referring to FIGS. 1-2, the mating face 11 of the housing 1 defines a first post 111 connecting one printed circuit board (not shown). And the board-mounting face 12 defines two second post 121 connecting another printed circuit board (not shown).

Referring to FIG. 3, each terminal 2 is a continuous strip of metal and deflectably moved within the passageways 14 from the side face 13. The terminal 2 includes a contacting portion 21 extending through the mating face 11, a retention portion 23 extending in the horizontal direction, an elastic curving portion 22 connecting the contacting portion 21 and the retention portion 23, a soldering portion 25 parallel to the board-mounting face 12 and a connecting portion 24 connecting the retention portion 23 and the soldering portion 25.

Referring to FIG. 4, the elastic curving portion 22 receiving in the first section 141 and the retention portion 23 retaining in the second section 142 are a C-shape. The curving portion 22 is wider than the contacting portion 21 in the direction which the terminals 2 are arranged (refer to FIG. 3), so that it can improve the spring of the curving portion 22. The retention portion 23 is parallel to the soldering portion 25, and the retention portion 23 is wider than the curving portion 22 in the direction which the terminals 2 are arranged (refer to FIG. 3). The slot 145 is under the retention portion 23, so it can prevent remainder water from breaking the electric connection of the terminals 2. Because the recess 131 of the side face 13 is defined, the curving portion 22 is closer to the inner face 1411 of the first section 141. The connecting portion 24 extends from the other end of the retention portion 23 opposite to the curving portion 22 and bends downwardly. The connecting portion 24 is received in the third section 143, so that the connecting portion 24 isn't easy to be knocked.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising: a dielectric housing having a mating face, a board-mounting face opposite to the mating face and a plurality of passageways extending through the mating face and the board-mounting face, each of the passageways defining a retaining section; a plurality of contacts secured in the housing and deflectably moved within the passageways with retention portions disposed in the retaining section; water drainage channels comprising at least one slot below the retaining section and an opening communicating with the board-mounting face; wherein the slot, the opening and the passageways communicate with each other.

2. The electrical connector as claimed in claim 1, wherein said passageways are arranged at two opposite sides connecting with the mating face and the board-mounting face.

3. The electrical connector as claimed in claim 2, wherein said slot is defines an inclined slot.

4. The electrical connector as claimed in claim 3, wherein said housing has two side faces bridging the mating face and the board-mounting face, and the passageways extend through the two side faces.

5. The electrical connector as claimed in claim 4, wherein said two side faces have a recess extending toward a middle of the housing and communicating with the passageways.

6. An electrical connector, comprising: a dielectric housing having a stand-off and a plurality of passageways extending from the stand-off, the stand-off having a board-mounting face and a face opposite to the board-mounting face; a plurality of contacts secured in the housing and deflectably moved within the passageways with retention portions disposed in retaining sections, the retaining sections extending from the face; water drainage channels comprising at least one slot depressing from the face and an opening extending through the board-mounting face; wherein the slot, the opening and the passageways communicate with each other.

7. The electrical connector as claimed in claim 6, wherein said slot is defines an inclined slot and under the retaining section.

8. The electrical connector as claimed in claim 7, wherein each of said contacts has an elastic curving portion extending upwardly from the retention portion, a contacting portion extending from the curving portion, a soldering tail parallel to the board-mounting face and a connecting portion connecting with the retention portion and soldering tail.

9. The electrical connector as claimed in claim 8, wherein each of said passageways has a first section upon the stand-off for receiving the curving portion and a third section at the side of the stand-off for receiving the connecting portion, the opening is under and communicates with the first section.

10. The electrical connector as claimed in claim 8, wherein said curving portion and retention portion are a C-shaped, the retention portion is wider than the curving portion in the direction which the contacts are arranged.

11. An electrical connector comprising: an insulative housing defining a plurality of passageways arranged in two rows; a plurality of contacts disposed in the corresponding passageways, respectively, each of said contacts including a curvedly extending resilient contacting section with a contacting tip above an upward mating face of the housing, a horizontal retention section connected to the curvedly extending resilient contacting section, and a soldering tail exposed on an exterior side face of the housing under condition that each of said contacts is sidewardly assembled to the corresponding passageway; a plurality of slots formed in the housing and located below the each corresponding retention section, respectively; and an opening formed in a center portion of the housing below said two rows of passageways; wherein said opening communicates with the passageways upwardly, the slots sidewardly, and an exterior downwardly for water drainage.

12. The electrical connector as claimed in claim 11, wherein the slots extends outwardly downwardly in an oblique way and away from the opening.

13. The electrical connector as claimed in claim 11, wherein said opening communicates with both two rows of passageways and the corresponding slots.

* * * * *